US006105958A

United States Patent [19]

van Veen et al.

[11] Patent Number: 6,105,958

[45] Date of Patent: Aug. 22, 2000

[54] SHEET COLLECTING DEVICE FOR COLLECTING SHEETS OF DIFFERENT DIMENSIONS ON SUPPORTS

[75] Inventors: Paul Gustaaf van Veen, Venlo; Petrus Josephus Maria van Bree, Someren; Johannes W. M. van den Bercken; Johannes M. van Bekkem, both of Venlo, all of Netherlands

[73] Assignee: Océ-Nederland B.V., MA Venlo, Netherlands

[21] Appl. No.: 08/815,583

[22] Filed: Mar. 12, 1997

[30] Foreign Application Priority Data

Mar. 12, 1996 [NL] Netherlands ..... 1002578

[51] Int. Cl.[7] ..... B65H 31/20

[52] U.S. Cl. ..... 271/213; 271/292; 271/305; 270/58.19; 270/58.14

[58] Field of Search ..... 271/292, 305, 271/213, 214; 270/58.19, 58.14

[56] References Cited

U.S. PATENT DOCUMENTS

| | | | |
|---|---|---|---|
| 3,847,391 | 11/1974 | Brant et al. . | |
| 5,203,550 | 4/1993 | Kawano et al. | 270/58.14 |
| 5,222,721 | 6/1993 | Miura et al. | 270/58.19 |
| 5,328,170 | 7/1994 | Coombs et al. | 271/213 X |
| 5,390,910 | 2/1995 | Mandel et al. . | |

FOREIGN PATENT DOCUMENTS

| | | | |
|---|---|---|---|
| 513754A1 | 5/1992 | European Pat. Off. . | |
| 60-102364 | 5/1985 | Japan . | |
| 176772 | 7/1989 | Japan | 271/213 |
| 83766 | 4/1991 | Japan | 271/292 |
| 292370 | 10/1992 | Japan | 271/292 |
| 94 15865 | 7/1994 | WIPO . | |

*Primary Examiner*—Christopher P. Ellis
*Assistant Examiner*—Patrick Mackey
*Attorney, Agent, or Firm*—Birch, Stewart, Kolasch & Birch, LL

[57] ABSTRACT

Sheet collecting device for the selective collection of sheets of different dimensions on a number of supports located below one another. Every support located below the uppermost support can be moved in a y-direction transversely of the x-direction in which sheets are fed onto the support, from a collection position in which the support is located substantially directly below the uppermost support and to an extraction position in which the support protrudes beyond the other supports. Every support can also be moved in the transverse y-direction between two collection positions which are displaced over a short distance in relation to one another in order to make a distinction between the sheets collected on the support. A warning light at every support warns a user not to move a support in use to its extraction position and to move a support in extraction position to the collection position when a sheet to be collected is fed in.

12 Claims, 7 Drawing Sheets

SHEET COLLECTING DEVICE FOR COLLECTING SHEETS OF DIFFERENT DIMENSIONS ON SUPPORTS

BACKGROUND OF THE INVENTION

1. Field of the Invention

The invention relates to a sheet collecting device for selectively collecting sheets of different dimensions on supports, comprising a number of supports located above one another, a sheet feed path which extends as far as the supports and guides which lead a sheet from the sheet feed path to a selected support.

2. Description of Background Art

A sheet collecting device is disclosed in PCT patent application WO 94/15865 wherein the device comprises a sheet feed path which extends in a vertical direction along a side edge of supports which are located above one another. Sheet transport paths are provided with sheet transport rollers which extend above each support in order to feed sheets which, seen in the direction of sheet transport, are shorter than the supports as far as an edge of a support which is opposite the side edge of the supports where the vertical sheet feed path extends.

A disadvantage of this known device is that the transport means above each support limit the effective collecting height between two supports.

OBJECTS AND SUMMARY OF THE INVENTION

The object of the present invention is to provide a device whereby sheets, irrespective of their format, which are collected on a support lie on top of one another with one edge to facilitate extraction of the sheets with one hand. The device of the present invention does not have the disadvantages of the aforementioned known device.

This task is solved according to the present invention in that at least one of the supports located below the uppermost support is movable between a collection position in which sheets can be collected on said support and an extraction position in which collected sheets can be extracted from said support.

As a result, sheets which are smaller than the supports can be easily extracted from the device without the trailing part of sheets to be collected having to be transported over a support.

In one advantageous embodiment of the device according to the present invention a support in the extraction position lies in the same plane as in the collection position but is displaced in a direction at right angles to the direction in which a sheet is fed onto the support. As a result, even small collected sheets can be grasped at the successive trailing edges lying on top of one another and can be extracted in a direction at right angles to the sheet feed direction.

In one advantageous embodiment of a device according to the present invention, every support can also be moved between a first collection position and a second collection position, which collection positions are displaced by some distance in relation to one another in a direction at right angles to the direction in which a sheet is fed onto the support.

As a result, common guide means can be used along which the support can be displaced between the collection positions and the extraction position.

In a further advantageous embodiment, on every support located below the uppermost support there is a coupling to link said support with a block which is movable back and forth over a distance corresponding to the distance between the first and second collection position and to disconnect the support from the block on displacement of the support into its extraction position, which coupling is preferably a magnetic coupling which can be disengaged manually.

As a result, a support can easily be put into its extraction position by hand from every collection position and every position in between and after the sheets have been extracted can be replaced into a position determined by the current position of the block.

According to another aspect of the present invention, first detection means are provided to detect every support in the first collection position furthest away from the extraction position, and control means are provided which can automatically position a support into the first collection position before the start of a period in which sheets can be collected on a support which is still empty.

As a result, in the extraction position of the support the bottom sheets on said support are pushed out the furthest so that said sheets and sheets lying displaced thereon can be extracted easily without great risk of the bottom sheets not being grasped when extracted and being left behind.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
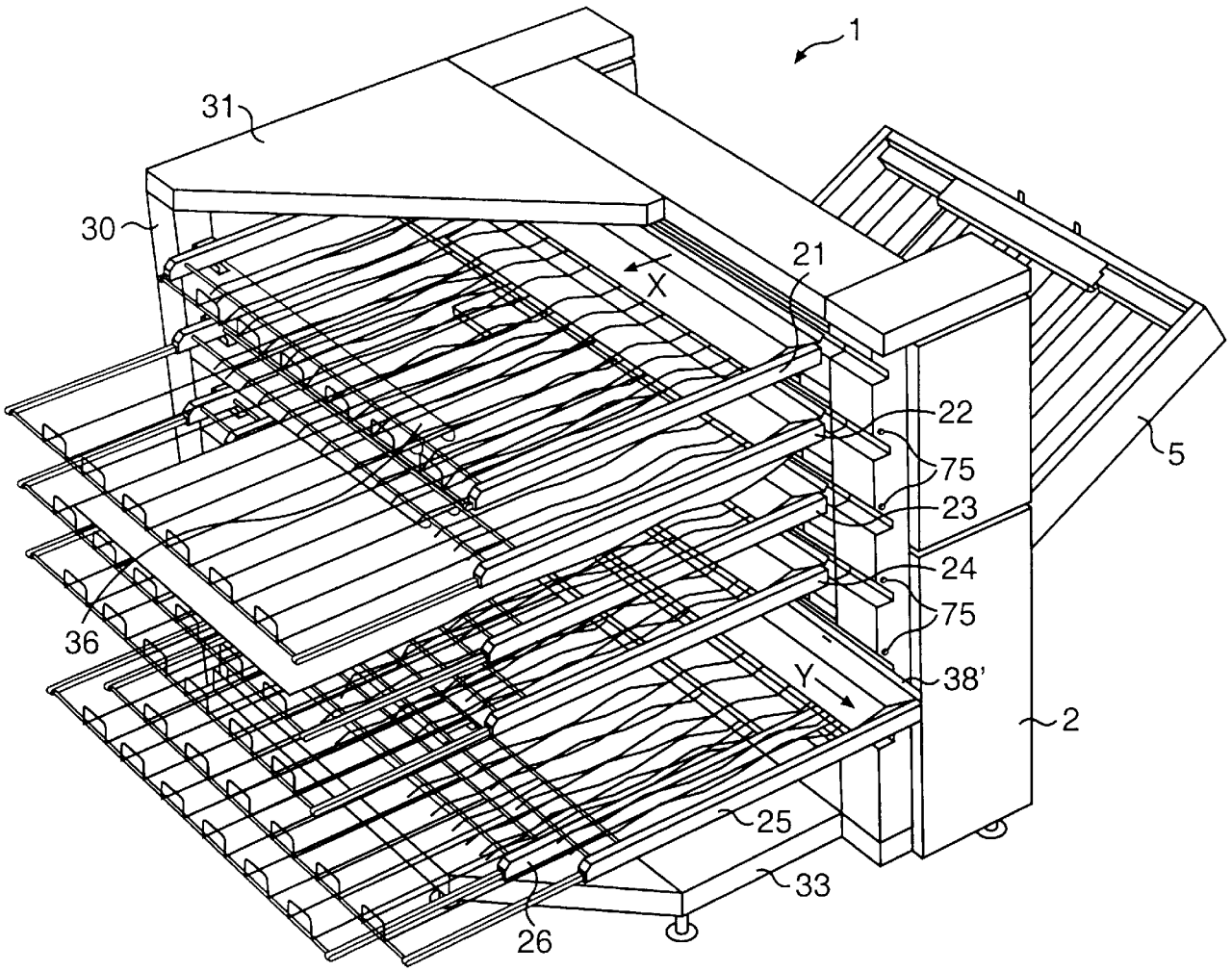
FIG. 1 is a perspective view of a device according to the present invention.
Figure 2:
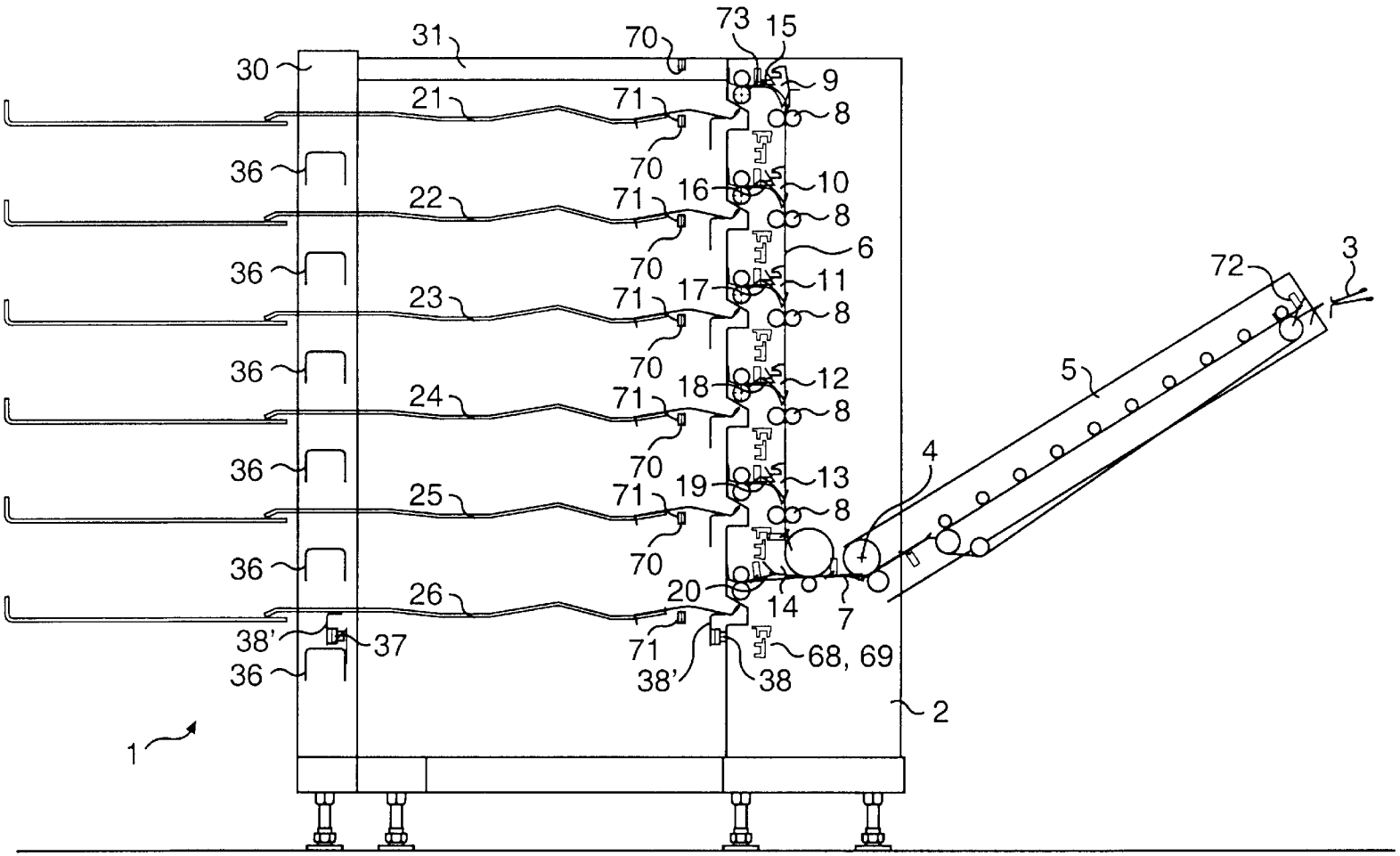
FIG. 2 is a front elevation of the device of FIG. 1.

The sheet collecting device shown in the FIGS. 1 and 2 includes a frame 1 with a pillar-shaped part 2 which can be placed against the side of a printer unit of which only the exit opening 3 for printed sheets is shown in FIG. 2. On the pillar-shaped part 2 a sheet transport unit 5 is secured for pivoting around shaft 4 so that the sheet collecting device may be connected to printer units with exit openings 3 at different heights. The pillar-shaped part 2 accommodates a sheet transport path 6 which extends substantially vertically. The bottom 7 of said path 6 adjoins the sheet transport path of the hinged sheet transport unit 5. The vertical sheet transport path 6 has pairs of transport rollers 8 at regular intervals and deflector elements 9 to 14 to divert sheets fed on transport path 6 off the path into short, horizontal exit paths 15 to 20 which are provided with transport rollers.

The uppermost deflector element 9 is fixed in a position to divert a sheet into exit path 15. Exit path 15 discharges into a sheet collecting tray formed by support 21. The other deflector elements 10 to 14 can selectively be put into an inactive position which is shown in FIG. 2, and into an active position in which they can selectively divert a sheet fed in path 6 into one of the exit paths 16, 17, 18, 19 or 20. Each of the exit paths 15 to 20 discharges into a sheet collecting tray formed by supports 22 to 26 which are located at regular intervals under support 21. Every support 21 to 26 has an effective width of 1100 mm and an effective length of 1240 mm which is suitable for accepting sheets of 914.4 mm (=36") in width and 1219.2 mm (=48") in length.

The minimum width of a sheet to be collected is 279.4 mm (=11"), being the longest side of a sheet fed in transversely. Thus, with sheets fed along a central line through the printer unit, a collected sheet which is the narrowest possible one comes to rest with its side edge a considerable distance from the side edge of the supports. In order to make it possible to extract such small sheets, the supports can be displaced laterally by a distance of a maximum of 300 mm. In FIG. 1 this position is shown for support 25. Sheets can therefore be easily extracted from an extended support. Because the uppermost support 21 is always highly accessible, the extension is only necessary for the supports 22 to 26 disposed below.

In order to be able to extend each of the supports 22 to 26, with the collecting direction shown in FIG. 1 by an arrow X, forwards in the direction shown by arrow Y in FIG. 1, the frame 1 comprises a pillar 30 next to the pillar-shaped part 2 at the back of the supports, which are located opposite the extraction side on the front. The pillar 30 is linked to the pillar-shaped part 2 by a triangular plate 31 above support 21 and a larger plate 33 under support 26, thus forming a very rigid frame. Pillar 30 carries a number of brackets 36 located above one another, each of which extends to the middle of a support in order to support each support separately. Each support 21 to 26 rests on rollers 37 which are rotatably attached to one of the brackets 36 and on rollers 38 which are rotatably attached to the pillar-shaped part 2, which rollers co-operate with guide rails 38' on each support as shown with support 26 in FIG. 2.

Figure 3:
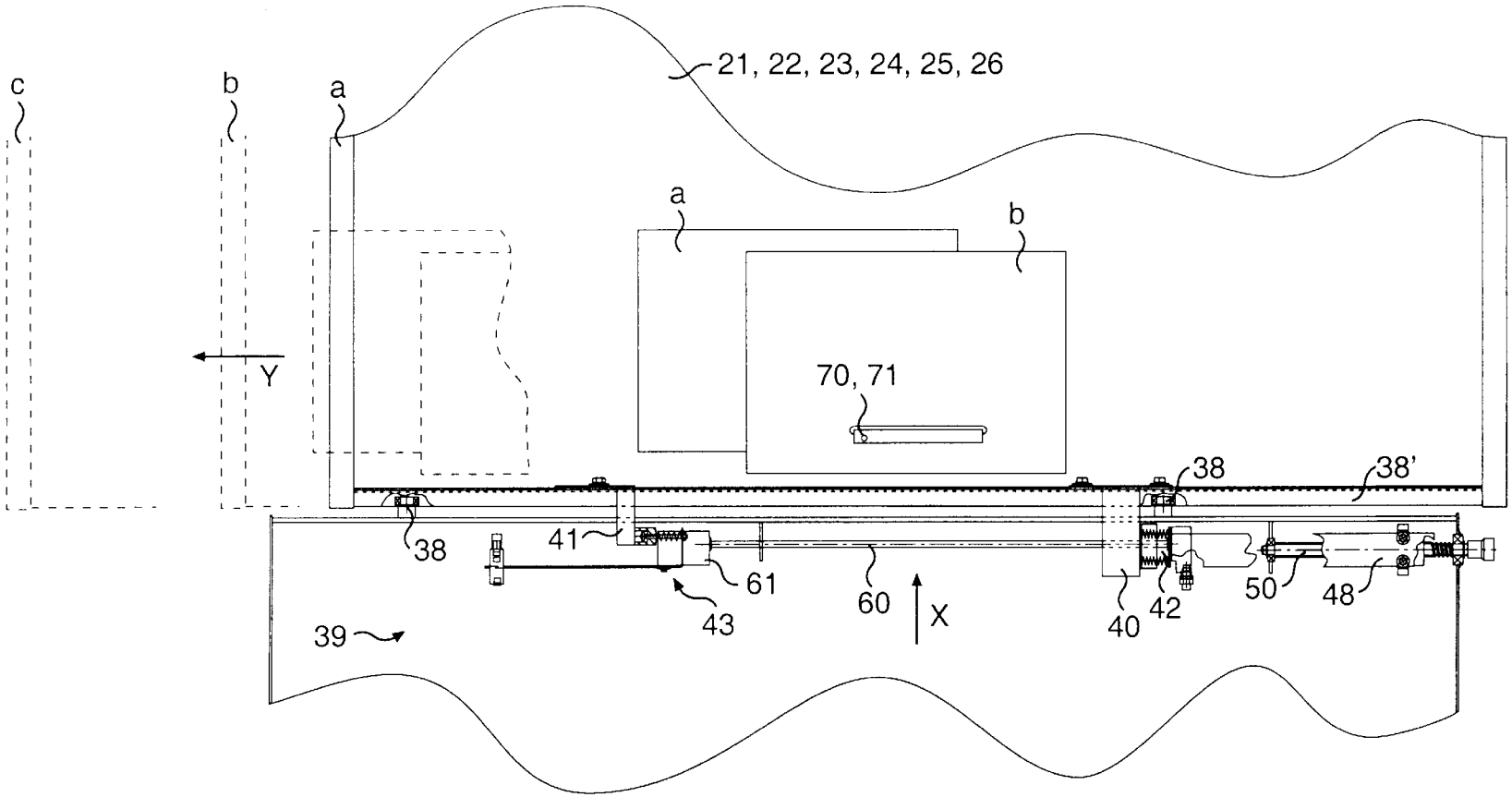
FIG. 3 is a top plan view of the device of FIGS. 1 and 2.
Figure 4:
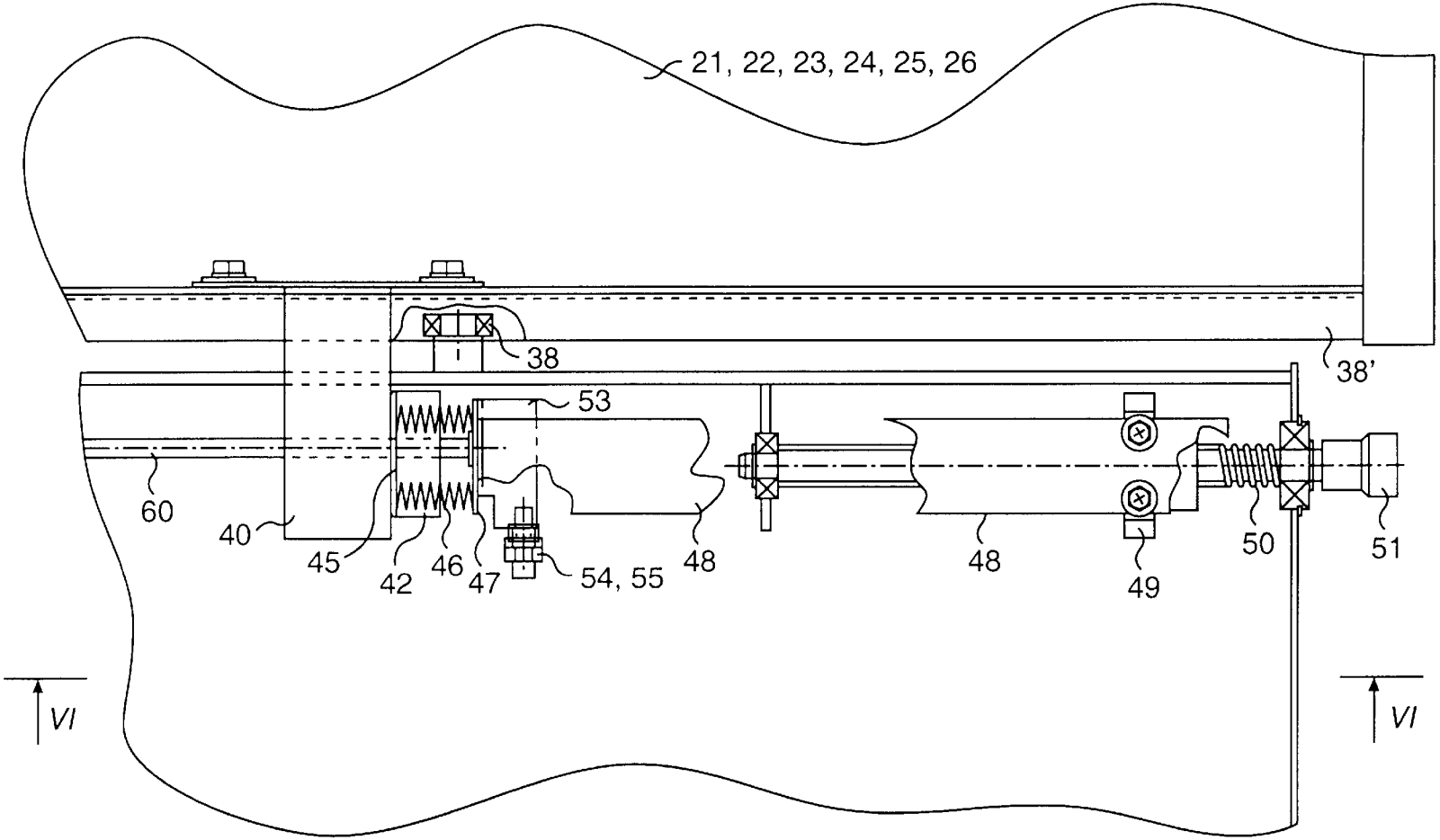
FIG. 4 is an enlarged detail of the top plan view of FIG. 3.
Figure 5:
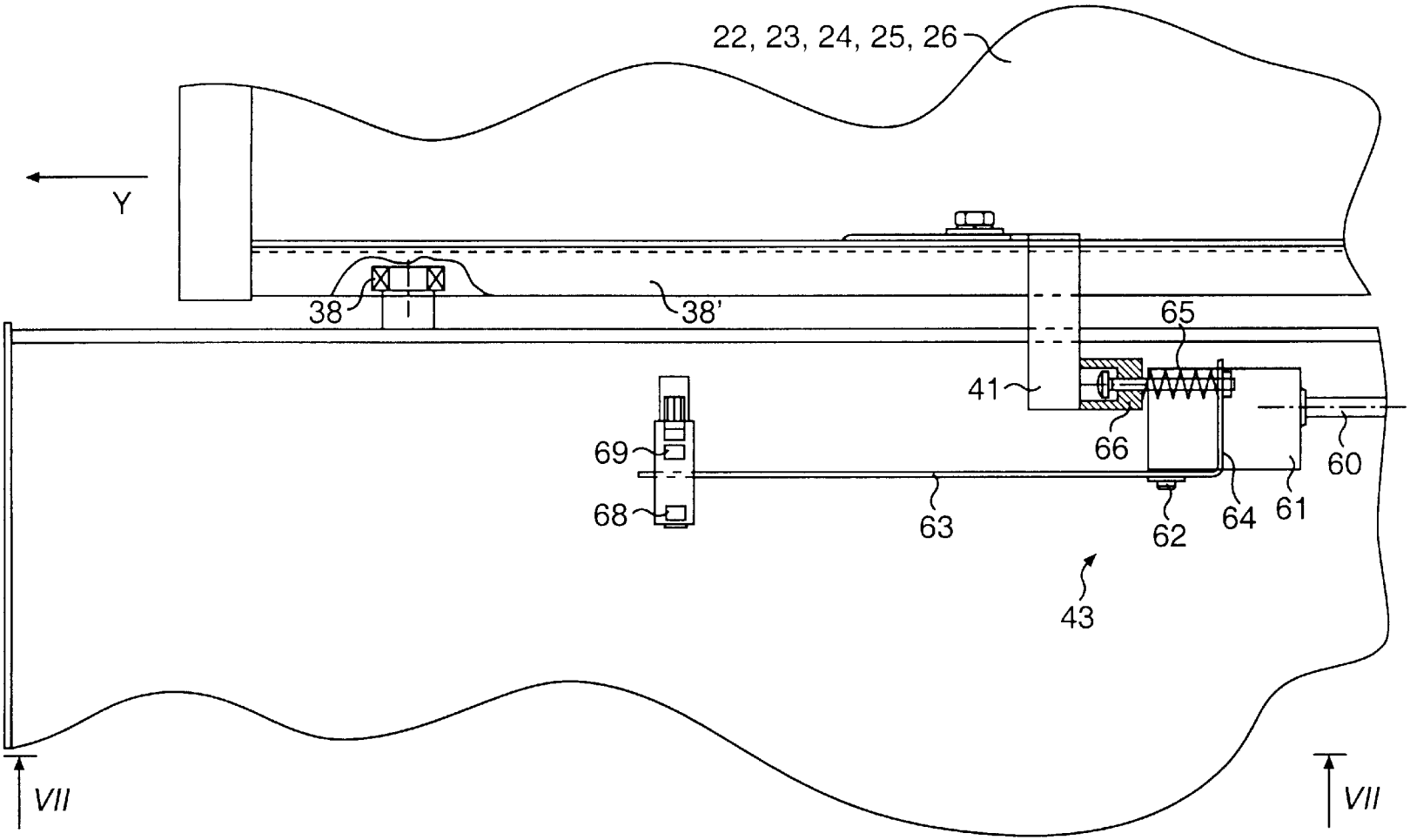
FIG. 5 is another enlarged detail of the top plan view of FIG. 3.
Figure 6:
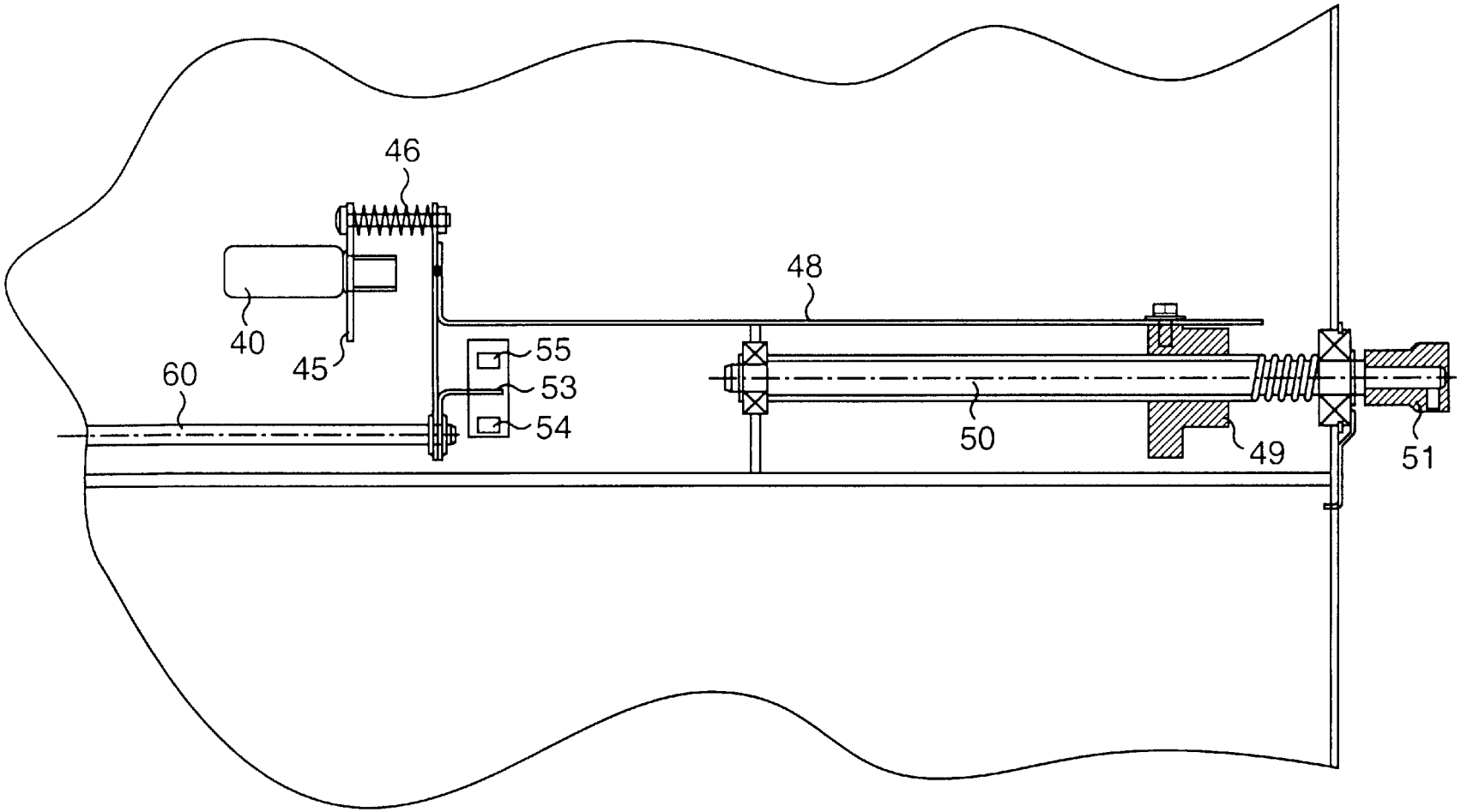
FIG. 6 is a view along line VI—VI in FIG. 4.
Figure 7:
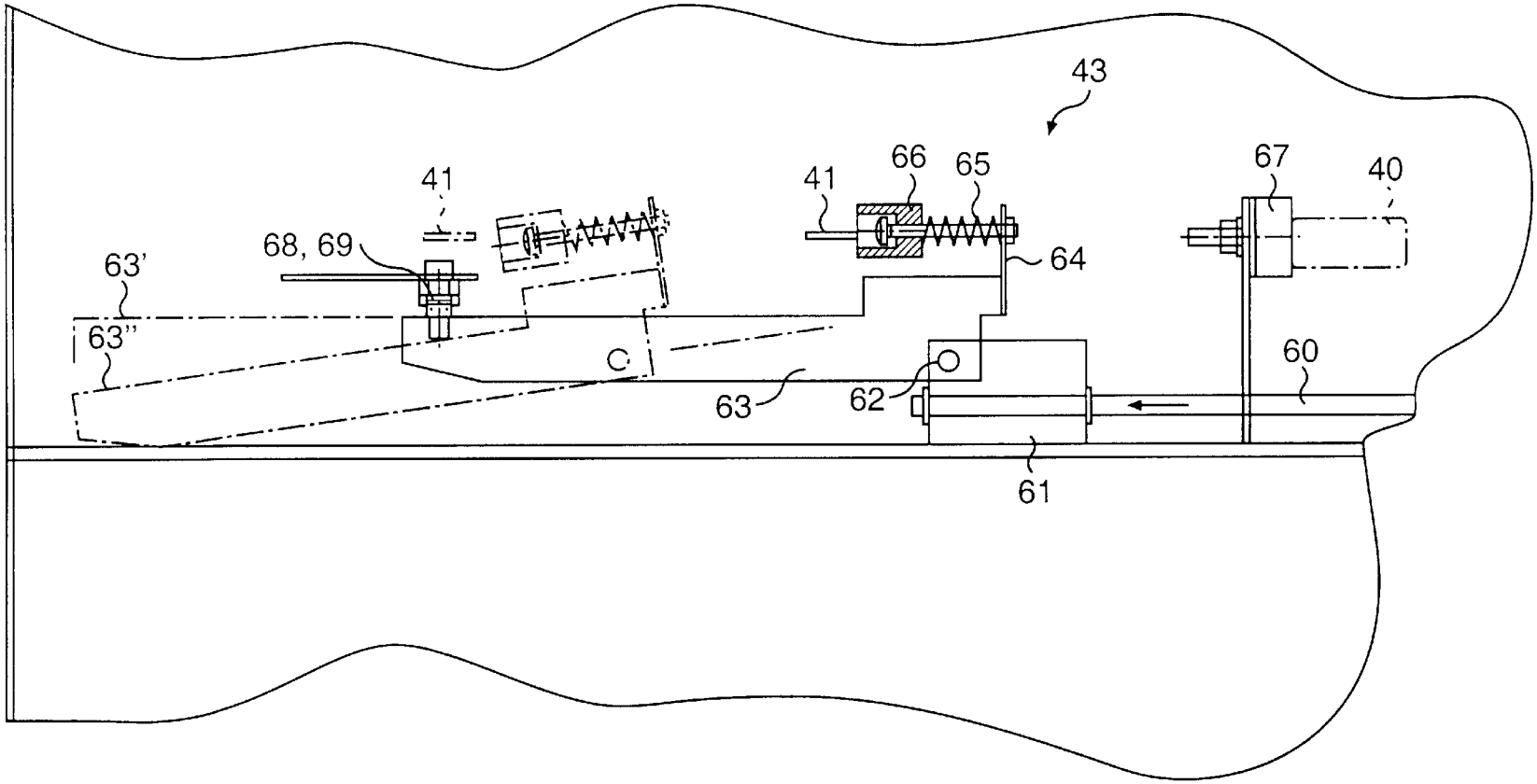
FIG. 7 a view along line VII—VII in FIG. 5.

In the pillar-shaped part 2 there is a mechanism 39 beneath each exit path 15 to 20 for transverse displacement of the corresponding supports 21 to 26 between two collection positions and the ability to displace each support 21 to 26 to an extraction position and back. The mechanism 39 for displacing a support will be described hereinafter with reference to FIG. 3 and the details shown in FIGS. 4–7.

Each support 21 to 26 has two projections 40 and 41 on the side facing the pillar-shaped part 2. The metal projection 40, shown best in FIGS. 4 and 6, can make contact with a permanent magnet 42 in the pillar-shaped part 2 and the projection 41, which is shown best in FIGS. 5 and 7, can make contact with a switch mechanism 43 which will be explained hereinafter. Magnet 42 is secured on a plate 45 which is linked by a resilient pin joint 46 to a plate 47 which in turn is fixed to a flanged lip of a bracket 48 which extends parallel to the support. The other end of the bracket 48 is fixed to a nut 49. A spindle 50 co-operating with nut 49 is rotatably mounted at its ends in frame 2. The spindle 50 can be driven in two directions by a motor (not shown) using a toothed belt pulley 51. When the motor is driven in one direction, the nut 49 moves from the initial position shown in FIG. 6 (which position is shown by the letter a in FIG. 3) over a distance of, for example, 100 mm to its other end position (which is shown by the letter b in FIG. 3). When the motor is driven in the other direction, the nut 49 moves back to the initial position shown in FIG. 6. When projection 40 makes contact with magnet 42 the support which is linked magnetically to projection 40 moves from one collection position to the other and back in order to collect sheets displaced sideways in relation to one another on said support. Plate 47 also carries a vane 53 which, in the initial position of the nut 49 shown in FIGS. 4 and 6, intercepts the beam of light emitted by the light source 54 in the direction of the light-sensitive element 55 and which, when the nut 49 and bracket 48 are moved out of the initial position, releases the beam of light emitted by the light source 54 for delivery of a detection signal by the sensor 55 to a control device (not illustrated), on the basis of which signal the control device knows that the adjusting mechanism 45 to 49 is not in its initial position.

Also connected to plate 47 is a rod 60 which extends approximately as an extension of the spindle 50 over a distance greater than the distance over which the support can be extended to an extraction position. The other end of the rod 60 carries a block 61 to which a pawl 63 is connected by a pivot 62. A flanged lip 64 on the pawl 63 carries a pin 65 on which a stop 66 is secured slidably in the direction of extension of the support. When the support is in the retracted position, a spring 65 pushes stop 66 against the projection 41 of the support. In this position, shown in unbroken lines in FIG. 5 and 7, pawl 63 intercepts the beam of. light emitted by the light source 68 in the direction of a light-sensitive element 69 for delivery of a detection signal to the control device (not illustrated) to show that the support concerned is in a non-extended position. If one of the supports 21 to 26 is pulled into an extraction position by hand (shown by c in FIG. 3) then projection 40 breaks contact with magnet 42 and stop 41 breaks contact with stop 66, irrespective of whether the support concerned was originally in its initial position with projection 41 in the position shown in unbroken lines in FIG. 7 or in the other collection position shown in broken lines in FIG. 7 or a position in between. The extreme extraction position (c) is defined by a fixed stop 67 against which projection 40 is held, as shown in broken lines in FIG. 7. When projection 41 is released from stop 66, the pawl 63, which has a length corresponding to the distance between the two collection positions, tilts under the influence of gravity from the position shown in unbroken lines in FIG. 7 to the position 63' shown in broken lines in FIG. 7. In this latter position 63', pawl 63 no longer intercepts the beam of light from light source 68 to the sensor 69 and the sensor 69 emits a signal to the control device on the basis of which the control device knows that the support concerned is in an extended position. The broken lines 63" show the position of the pawl 63 when the support is in a displaced collection position, in which position the elongate pawl 63 intercepts the beam of light between the light source 68 and the sensor 69 just as in the undisplaced collection position.

The sheet collecting device as described above is provided with a control device comprising a setup system, a detection system and a signalling system.

The setup system comprises:

a) means for setting up one of the following collection methods a1) stacked collection (copy stack)

In this collection method successively fed sheets are collected on the uppermost support until the uppermost collection tray is full, after which the next sheets are collected on the support directly below the uppermost support until that collection tray is also full, and the next sheets are collected on the next support and so on. The collection of sheets is interrupted when all the collection trays formed by the supports are full.

a2) collection on a specific tray (addressable tray)

In this collection method successively fed sheets are collected exclusively on a specific support. The collection of sheets is interrupted when the collection tray concerned is full.

a3) collection by job (job per tray)

In this collection method successively fed sheets belonging to a job are collected on a specific support or, if the job is too large for collection on one support, on the next support too. Sheets belonging to a following job are, optionally, collected in a displaced position on top of the sheets of the previous job or in an undisplaced position on the support below.

a4) collection by set (set per tray)

In this collection method successively fed sheets belonging to a set are collected on a specific support or, if the set is too large for collection on one support, on the next support too. A set consists of a set number of sheets belonging together within a job. For example, if a job consists of collecting six copies of a set of three originals, the job consists of six sets with the 1st, 4th, 7th, 10th, 13th and 16th sheets being considered as the first sheet of a set, which first sheets are, optionally, collected in a displaced position on top of the previous sheet or in an undisplaced position on the support below.

The setup system also comprises:

b) means for setting up the number of the collection tray necessary for executing the collection method set up: collection in a specific tray.

c) means for activating displaced collection, which displaced collection as described above is applicable in the first instance to the collection methods set up:
collection by job (a3)
collection by set (a4).

Because displaced collection is a separate setting, it can also be set up with a1 and a2.

The detection system comprises:

1) detection means at each collection tray to determine whether or not the support concerned is in an extended extraction position. These detection means comprise the pawl 63 and optical sensor 68, 69 as described above.

2) detection means at each collection tray to determine whether or not the support concerned is in its initial position. These detection means comprise the vane 53 and optical sensor 54, 55 as described above.

3) detection means at each collection tray to determine whether or not there is one or more sheets lying on the support concerned. These detection means comprise a light source 70 and a light-sensitive element 71 (together forming the optical sensor 70, 71) set up on both sides of each support, whereby one or more sheets lying on the support interrupt the beam of light from the light source 70 concerned to element 71.

4) detection means to determine whether a sheet has been fed into the sheet collecting device. These detection means comprise a sensor 72 located at the entrance to the sheet transport unit 5 and reacting to the passage of the front edge of a sheet as an indication that said sheet has been fed into the sheet collecting device.

5) detection means at each collection tray to determine whether a sheet fed in has been fed in its entirety to a collection tray. These detection means comprise a sensor 73 located in every exit path 15 to 20 and reacting to the passage of the rear edge of a sheet as an indication that said sheet has been fed in its entirety onto the support.

It will be clear that the optical sensors 54, 55 and 68, 69 can also be designed as mechanical sensors. Furthermore, sensors are located at regular intervals in the sheet transport path to monitor the continuous transport of sheets in the device and to detect transport faults.

The signalling system comprises indicator lights 75 (see FIG. 1) on the front edge of the pillar-shaped part 2 at each collection tray, which lights can each be activated separately and continuously and can flash synchronously at different frequencies. The flashing can be backed up by a sound source which buzzes at the same time, as will be explained hereinafter.

The sheet collecting device described above operates and is controlled as follows:

When the front edge of a sheet fed into the sheet collecting device passes sensor 72 at the entrance of the sheet transport unit 5, this sensor 72 emits a signal to the control device, resulting in activation of the light at the collection tray in which the sheet concerned is to be collected on the basis of the collection method set up and the detected filling level of the collection trays.

The control device also selectively activates one of the deflector elements 10, 11, 12, 13 or 14 at the collection tray concerned. of course, this only needs to happen when the front edge of the sheet concerned has arrived at the relevant deflector element. When the sheet has been collected in the relevant collection tray, this is signalled to the control device with the passage of the rear edge of the sheet past sensor 73 in the relevant exit path 15, 16, 17, 18, 19 or 20. The deflector element concerned is then reset into its non-deflecting initial position and the control device extinguishes the light at the relevant collection tray to indicate that the sheet has been collected, unless there are still sheets passing through which are intended for that tray. It is possible for there to be at any given point in time several sheets in the feed path which are intended for collection in different collection trays. The lights at the various collection trays will then be continuously activated at the same time to indicate that sheets will be collected in them and those collection trays may not therefore be extended to an extraction position in order to avoid a transport fault. When a collection tray is full, this is detected by the control device when the counted number of fed sheets collected in the collection tray after a tray-empty signal emitted by optical sensor 70, 71 matches a predetermined maximum number of sheets to be collected in that tray. The control device then sets the lamp at that collection tray flashing at a low frequency to indicate that the operator can empty that collection tray. However, a transition from continuous activation flashing only occurs on completion of the collection of all the sheets intended for that collection tray and still moving in the feed path (or still in the connected printer unit) when tray-full is detected. When tray-full is detected, the control device also generates an error signal which can be used to interrupt the printing and feeding of successive copies by a printer unit connected to the sheet collecting device. As with continuous activation, the lights at several collection trays can flash simultaneously.

When the sheet collecting device is in ready-for-collection mode, all the supports are in their initial position, which is checked because in that position the vane 53 protrudes between the optical sensor 54, 55 on each support. When the collection methods "collection by job", "collection by set", "stacked collection" or "collection in a specific tray" are set up and when "displaced collection" is set up at the same time, the support concerned will be in its initial position for the first sheet of the job and thereafter before the collection of each successive first sheet of the next job or first sheet of the next set it will be moved by a distance of, for example, 100 mm by the drive 49, 50, 51 to another sideways displaced collection position.

Each support can be pushed out to an extraction position at any time in order to extract collected sheets. This can be done without obstruction in the absence of continuous activation of the light at the collection tray which the operator wants to pull out. When a light is continuously activated and the operator opens that collection tray, the light at that collection tray will start to flash at a high frequency to indicate that sheets are being transported to that collection tray and the operator should close the open tray again quickly to avoid a sheet transport fault. This warning light signalling can be backed up by a buzzer which buzzes in time with the quickly flashing light. When the collection tray is closed, this flashing stops again, as does the buzzer except if this problem occurs at several collection trays.

If sensor 72 signals that a sheet intended for an open collection tray is entering the device, the light concerned will flash quickly and the buzzer will also buzz quickly. When a light is flashing quickly the operator still has a few seconds to close the collection tray before the sheet enters the collection tray. This time is, for example, 6 to 12 seconds, depending on where in the feed path the sheet is located and the time taken until the sheet arrives at the collection tray. If a support is (still) open when a sheet enters the collection tray concerned, or if a support is pushed open while a sheet is entering, a sheet transport fault is signalled and sheet transport stops immediately in order to give the operator the opportunity manually to remove sheets which are still (stuck) in the device. Collection can then be resumed again from the next sheet which is fed into the device. When several collection trays are open while sheets are being transported, all the lights concerned and the buzzer flash quickly.

There follows an overview of the light status (off, continuously on, slow flashing, quick flashing) depending on the operating mode of the device, viz. tray extended (signalled by sensor 69), sheets being transported to the collection tray concerned (signalled by sensors 72 and 73 in the transport path), the collection tray concerned is full (signalled by optical sensor 70, 71 and collection of a predetermined number of sheets in the collection tray concerned).

| tray open signal (second signal in claims) | tray in use signal (third signal in claims) | tray full signal (fourth signal in claims) | light status |
|---|---|---|---|
| no | no | no | off |
| yes | no | no | off |
| no | yes | no | continuously on |
| no | yes | yes | continuously on |

-continued

| tray open signal (second signal in claims) | tray in use signal (third signal in claims) | tray full signal (fourth signal in claims) | light status |
|---|---|---|---|
| no | no | yes | slow flashing |
| yes | no | yes | slow flashing |
| yes | yes | no | quick flashing |
| yes | yes | yes | quick flashing |

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sheet collecting device for selectively collecting sheets of different dimensions on supports, comprising:

a number of supports located above one another;

a sheet feed path extending as far as the supports; and guide means for leading a sheet from the sheet feed path to a selected support;

every support being movable between a first collection position and a second collection position, the collection positions being displaced a predetermined distance in relation to each other in a direction at right angles to the direction in which a sheet is fed onto the support;

wherein every support located below an uppermost support is adjustably movable between the collection positions in which sheets of different dimensions can be collected on said support and extraction positions in which collected sheets can be extracted from said support;

said collection positions and the extraction position lie on a straight line;

every support located below the uppermost support is provided with a coupling for linking every support located below the uppermost support with a block which is movable back and forth over a distance corresponding to the distance between the first collection position and the second collection position and for automatic disconnection of the support from the block when the support is moved to its extraction position.

2. The sheet collecting device according to claim 1, wherein a support in the extraction position lies in the same plane as in the collection position, and is displaced in a direction at right angles to the direction in which a sheet is fed onto said support.

3. The sheet collecting device according to claim 1, wherein the coupling is a magnetic coupling which has a coupling force which can be manually disengaged.

4. The sheet collecting device according to claim 1, and further including first detection means for detecting every support in the first collection position furthest away from the extraction position and for generating a first detection signal, first control means being provided from automatically setting the support in the first collection position before the start of a period in which sheets can be collected on a support which is still empty.

5. The sheet collecting device according to claim 4, wherein second detection means are present for detecting a support in an extraction position.

6. The sheet collecting device according to claim 1, wherein detection means are present for detecting a support in an extraction position and the detection means react to the disconnection of the coupling between the support and the reciprocating block.

7. The sheet collecting device according to claim 5, and further including second control means for generating a second signal in response to the said detection by the second detection means.

8. The sheet collecting device according to claim 6, and further including second control means for generating a second signal in response to the said detection by the second detection means.

9. The sheet collecting device according to claim 5, and further including third detection means at the sheet feed path for detecting a sheet fed in being transported to the selected support, in response to which detection a third control means generates a warning third signal indicating that the relevant support is in use.

10. The sheet collecting device according to claim 9, and further including fourth detection means for detecting the absence of sheets on one of the supports and counting means for counting the number of sheets collected on the support and in that fourth control means are present which, in response to a counted number of sheets corresponding to a predetermined maximum number of sheets to be collected on said support, generate a fourth signal indicating that the maximum permissible number of sheets has been collected on said support.

11. The sheet collecting device according to claim 9, and further including a warning light at each support and that the control means continuously activate the warning light at a selected support in the presence of the third signal but in the absence of the second signal to indicate that the selected support is in a collection position and is in operation, slowly flashes the warning light at the support concerned in the presence of the fourth signal but in the absence of the third signal to indicate that the maximum number of sheets is lying on that support quickly flashes the warning light in the presence of the second and third signals to indicate that the support concerned has to be moved from the extraction position into the operating position because the selected support is in operation.

12. The sheet collecting device according to claim 10, and further including a warning light at each support and that the control means continuously activate the warning light at a selected support in the presence of the third signal but in the absence of the second signal to indicate that the selected support is in a collection position and is in operation, slowly flashes the warning light at the support concerned in the presence of the fourth signal but in the absence of the third signal to indicate that the maximum number of sheets is lying on that support quickly flashes the warning light in the presence of the second and third signals to indicate that the support concerned has to be moved from the extraction position into the operating position because the selected support is in operation.

* * * * *